US009158222B2

(12) United States Patent
Osada

(10) Patent No.: US 9,158,222 B2
(45) Date of Patent: Oct. 13, 2015

(54) BIAS APPLYING UNIT, A CHARGING UNIT, AND AN IMAGE FORMING APPARATUS COMPRISING THE SAME

(71) Applicant: Konica Minolta, Inc., Chiyoda-ku (JP)

(72) Inventor: Morio Osada, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/327,751

(22) Filed: Jul. 10, 2014

(65) Prior Publication Data

US 2015/0023697 A1 Jan. 22, 2015

(30) Foreign Application Priority Data

Jul. 17, 2013 (JP) ..... 2013-148634

(51) Int. Cl.
*G03G 15/02* (2006.01)

(52) U.S. Cl.
CPC ..... *G03G 15/0266* (2013.01)

(58) Field of Classification Search
CPC ..... G03G 15/0266; G03G 15/0283
See application file for complete search history.

(56) References Cited

U.S. PATENT DOCUMENTS 5,412,455 A * 5/1995 Ono et al. ..... 399/176
5,652,649 A 7/1997 Ikegawa et al.
8,725,014 B2 5/2014 Hotomi et al.
2010/0221026 A1* 9/2010 Komatsu ..... 399/50
2010/0239286 A1* 9/2010 Hanashi ..... 399/50
2010/0239287 A1* 9/2010 Shibuya ..... 399/50
2011/0158664 A1 6/2011 Hotomi et al.

FOREIGN PATENT DOCUMENTS

JP 8-137197 A 5/1996
JP 10-186807 A 7/1998
JP 2001-201921 A 7/2001
JP 2011-150309 A 8/2011

OTHER PUBLICATIONS

Notification of Reasons for Refusal issued in corresponding Japanese Patent Application No. 2013-148634, mailed Jul. 14, 2015, with English translation (5 pages).

* cited by examiner

*Primary Examiner* — Rodney Bonnette
(74) *Attorney, Agent, or Firm* — Buchanan Ingersoll & Rooney PC

(57) ABSTRACT

An image forming apparatus including: a contact charging unit that is in contact with a photoreceptor and electrically charges the photoreceptor by causing electric discharge; a bias applying unit that applies an AC bias to the contact charging unit; and a superposing unit that superposes a DC bias onto the AC bias, the DC bias having a same polarity as a charge polarity of the photoreceptor. The AC bias has a same waveform as a rectangular wave bias during a period in which an absolute value of the AC bias is smaller than an absolute value of a predetermined boundary voltage, and the absolute value of the AC bias increases at a slower rate than an absolute value of the rectangular wave bias during a period in which the absolute value of the AC bias is equal to or greater than an absolute value of a discharge start voltage.

7 Claims, 12 Drawing Sheets

FIG. 4

| | Vth [V] | Vpp [V] | Frequency [Hz] | Higher potential range | | Lower potential range | | Film thickness of photoreceptor | Environmental condition | Discharge time ratio | Referential ratio | Image deletion | Non-uniform charging |
|---|---|---|---|---|---|---|---|---|---|---|---|---|---|
| | | | | Vpp [V] | Waveform | Vpp [V] | Waveform | | | | | | |
| Example 1 | -1000 | 1600 | 1800 | 1200 | Rectangular waveform | 400 | Triangular waveform | Normal | Normal | 1.000 | 0.460 | ○ | ○ |
| Example 2 | -1000 | 1800 | 1800 | 1200 | Rectangular waveform | 600 | Triangular waveform | Normal | Normal | 1.000 | 0.535 | ○ | ○ |
| Example 3 | -1000 | 1800 | 1800 | 1200 | Rectangular waveform | 600 | Sine waveform | Normal | Normal | 1.000 | 0.535 | ◎ | ○ |
| Example 4 | -1100 | 1600 | 1800 | 1400 | Rectangular waveform | 200 | Triangular waveform | Thick | Normal | 1.000 | 0.322 | ○ | ○ |
| Example 5 | -1100 | 1800 | 1800 | 1400 | Rectangular waveform | 400 | Triangular waveform | Normal | Low-temperature, low humidity | 1.000 | 0.433 | ◎ | ○ |
| Example 6 | -1200 | 1800 | 1800 | 1600 | Rectangular waveform | 200 | Triangular waveform | Thick | Low-temperature, low humidity | 1.000 | 0.303 | ○ | ○ |
| Comparative Example 1 | -1000 | 1600 | 1800 | 0 | N/A | 1600 | Sine waveform | Normal | Normal | 0.460 | 0.460 | ○ | × |
| Comparative Example 2 | -1000 | 1600 | 2000 | 0 | N/A | 1600 | Sine waveform | Normal | Normal | 0.460 | 0.460 | × | ○ |
| Comparative Example 3 | -1000 | 2000 | 1800 | 0 | N/A | 2000 | Sine waveform | Normal | Normal | 0.590 | 0.590 | × | ○ |
| Comparative Example 4 | -1000 | 1600 | 1800 | 1600 | Rectangular waveform | 0 | N/A | Normal | Normal | 1.000 | 0.460 | △ | × |
| Comparative Example 5 | -1000 | 1600 | 1800 | 400 | Rectangular waveform | 1200 | Triangular waveform | Normal | Normal | 0.333 | 0.460 | ○ | × |

Example 1

Example 2

Example 3

Example 4

Example 5

Example 6

Comparative Example 1

Comparative Example 2

Comparative Example 3

Comparative Example 4

Comparative Example 5

BIAS APPLYING UNIT, A CHARGING UNIT, AND AN IMAGE FORMING APPARATUS COMPRISING THE SAME

CROSS-REFERENCE TO RELATED APPLICATIONS

This application is based on application No. 2013-148634 filed in Japan, the contents of which are hereby incorporated by reference.

BACKGROUND OF THE INVENTION (1) Field of the Invention

The present invention relates to electrophotographic image forming apparatuses and in particular to technology of charging a photoreceptor in a preferable manner by securing a sufficient amount of discharge current without applying high voltage.

(2) Related Art

In an electrophotographic image forming apparatus, it is necessary to uniformly charging the surface of a photoreceptor before forming an electrostatic latent image on the surface of the photoreceptor. Methods of charging can be classified roughly into non-contact charging methods and contact charging methods. Examples of the contact charging methods include a roller charging method and a brush charging method. The roller charging method is a method of charging the surface of the photoreceptor by applying voltage to a charging roller that is in contact with the surface of the photoreceptor.

When the roller charging method is employed, applying an alternating current (AC) voltage allows for more uniform charging onto the photosensitive drum as compared to applying a direct current (DC) voltage only. In particular, if AC bias having a peak-to-peak voltage Vpp that is equal to or greater than twice the difference between the DC voltage and the discharge start voltage Vth is applied, the amount of discharge current increases and leads to stable charging. Note that peak-to-peak voltage Vpp denotes the difference in potential between the maximum voltage Vmax and the minimum voltage Vmin, and the discharge start voltage Vth denotes the voltage that causes discharge to occur between the photoreceptor and the charger.

However, if the discharge current is increased in amount under a high-humidity environment, image deletion, which is caused by adhesion of the product of the discharge, will become more likely to occur. Considering this, there has been a proposal of a charge control method for determining the peak-to-peak voltage Vpp by measuring the amount of current flowing through the charging roller (See Japanese Patent Application Publication No. 2001-201921).

Meanwhile, image forming apparatuses are recently used under a low-temperature and low-humidity environment more frequently. Under a low-temperature and low-humidity environment, the charging device increases in electrical resistance for example, and there is a risk of the occurrence of a charging failure. Even in such a case, it is possible to prevent the occurrence of a charging failure by increasing the peak-to-peak voltage Vpp, because this increases the amount of discharge current. For this reason, there also has been a proposal of an image forming apparatus that changes the peak-to-peak voltage Vpp according to the temperature within the apparatus (See Japanese Patent Application No. 2011-150309).

However, the above-described conventional technologies require an ammeter for measuring the amount of current flowing through the charging roller, and also require a temperature sensor for measuring the temperature within the apparatus. Therefore, in either of the conventional technologies, an increase in parts cost and manufacturing cost is inevitable. Furthermore, since it is necessary to improve the voltage endurance in order to increase the peak-to-peak voltage Vpp, an increase in cost and power consumption of the power supply device for example is also inevitable.

Moreover, the increase in peak-to-peak voltage Vpp also causes problems such as short life as well as the image deletion resulting from the increase in the product of the discharge as described above, because the photoreceptor wears out quickly due to the high voltage.

SUMMARY OF THE INVENTION

The present invention is made in view of the above-described problems, and aims to provide an image forming apparatus that is capable of realizing favorable charging by increasing the amount of discharge current without increasing the peak-to-peak voltage Vpp.

To achieve the aim, one aspect of the present invention provides an image forming apparatus for forming an image from an electrostatic latent image generated by exposing an electrically charged photoreceptor to light, comprising: a contact charging unit that is in contact with a photoreceptor and electrically charges the photoreceptor by causing electric discharge; a bias applying unit that applies an alternating current bias to the contact charging unit; and a superposing unit that superposes a direct current bias onto the alternating current bias, the direct current bias having a same polarity as a charge polarity of the photoreceptor, wherein the alternating current bias has a same waveform as a rectangular wave bias during a period in which an absolute value of the alternating current bias is smaller than an absolute value of a predetermined boundary voltage, and the absolute value of the alternating current bias increases at a slower rate than an absolute value of the rectangular wave bias during a period in which the absolute value of the alternating current bias is equal to or greater than an absolute value of a discharge start voltage, the discharge start voltage being a voltage at which the electric discharge occurs between the contact charging unit and the photoreceptor and having a same polarity as the charge polarity of the photoreceptor, and the absolute value of the predetermined boundary voltage being no greater than the absolute value of the discharge start voltage, and a discharge time provided by the alternating current bias, for which the absolute value of the alternating current bias is equal to or greater than the absolute value of the discharge start voltage, is longer than the discharge time provided by a sinusoidal wave bias having a same frequency and a same amplitude as the alternating current bias, and is no longer than the discharge time provided by a rectangular wave bias having the same frequency and the same amplitude as the alternating current bias.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings:

FIG. 4 is a table showing evaluation conditions for evaluating the performance in charging;

DESCRIPTION OF PREFERRED EMBODIMENTS

The following describes an image forming apparatus pertaining to an embodiment of the present invention, with reference to the drawings.

[1] Structure of Image Forming Apparatus

First of all, the structure of an image forming apparatus pertaining to the present embodiment is described.

Figure 1:
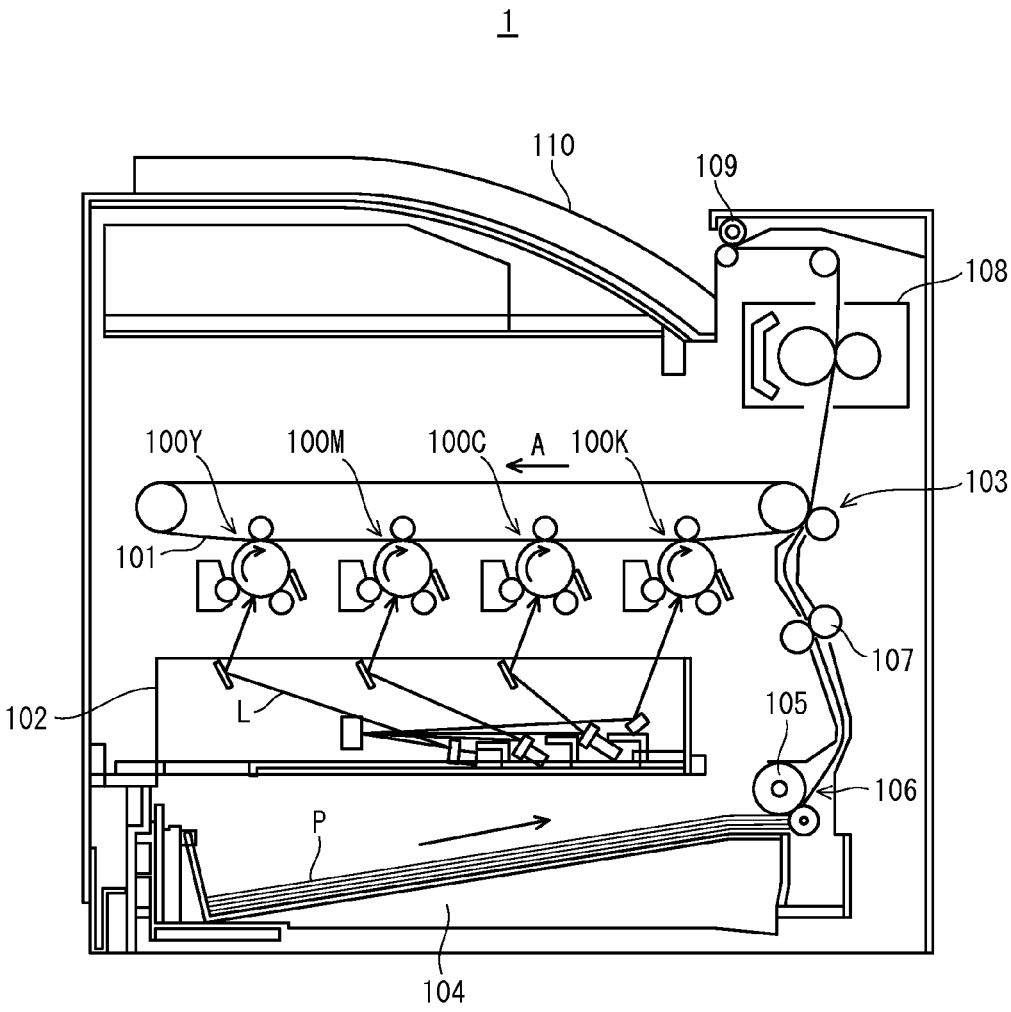
FIG. 1 shows primary components of an image forming apparatus pertaining to Embodiment of the present invention.

As shown in FIG. 1, an image forming apparatus 1 pertaining to the present embodiment is a tandem color printer, and image creating units 100Y through 100K are arranged along an intermediate transfer belt 101. The image creating units 100Y through 100K each receive image exposure light (L) from an exposure device 102 and respectively form toner images of the colors yellow (Y), magenta (M), cyan(C) and black (K). Then, the image creating units 100Y through 100K statically transfer the toner images on the intermediate transfer belt 101 so that the images overlap each other on the intermediate transfer belt 101 (i.e. primary transfer). Thus a color toner image is formed. Alternatively, a monochrome toner image of the color K may be formed.

The intermediate transfer belt 101 is an endless belt, and rotates in the direction indicated by the arrow A while carrying the toner images. Thus the color toner image is transported toward a pair of secondary transfer rollers 103. The secondary transfer rollers 103 are pressed against or separated from each other by a press/separation mechanism, which is omitted from the drawing. The area where the pair of secondary transfer rollers 103 are pressed against each other is referred to as "secondary transfer nip".

The recording sheets P are housed within a paper feed cassette 104, and are conveyed onto a transport path 106 one at a time by a pickup roller 105. Each recording sheet P conveyed onto the transport path 106 is transported to the secondary transfer nip by the control of the timing roller 107 according to secondary transfer timing.

When the toner image carried by the intermediate transfer belt 101 and the recording sheet P synchronously pass through the secondary transfer nip, secondary transfer bias is applied between the pair of secondary transfer rollers 103. Thus the toner image on the intermediate transfer belt 101 is statically transferred onto the recording sheet P (i.e. secondary transfer).

The toner image on the recording sheet P is thermally fixed when the recording sheet P passes through the fixing device 108. After that, the recording sheet P is ejected onto a catch tray 110 by an ejection roller 109.

[2] Structure of Image Creating Unit 100

Next, the following describes the further details of the structure of the image creating unit 100.

Figure 2:
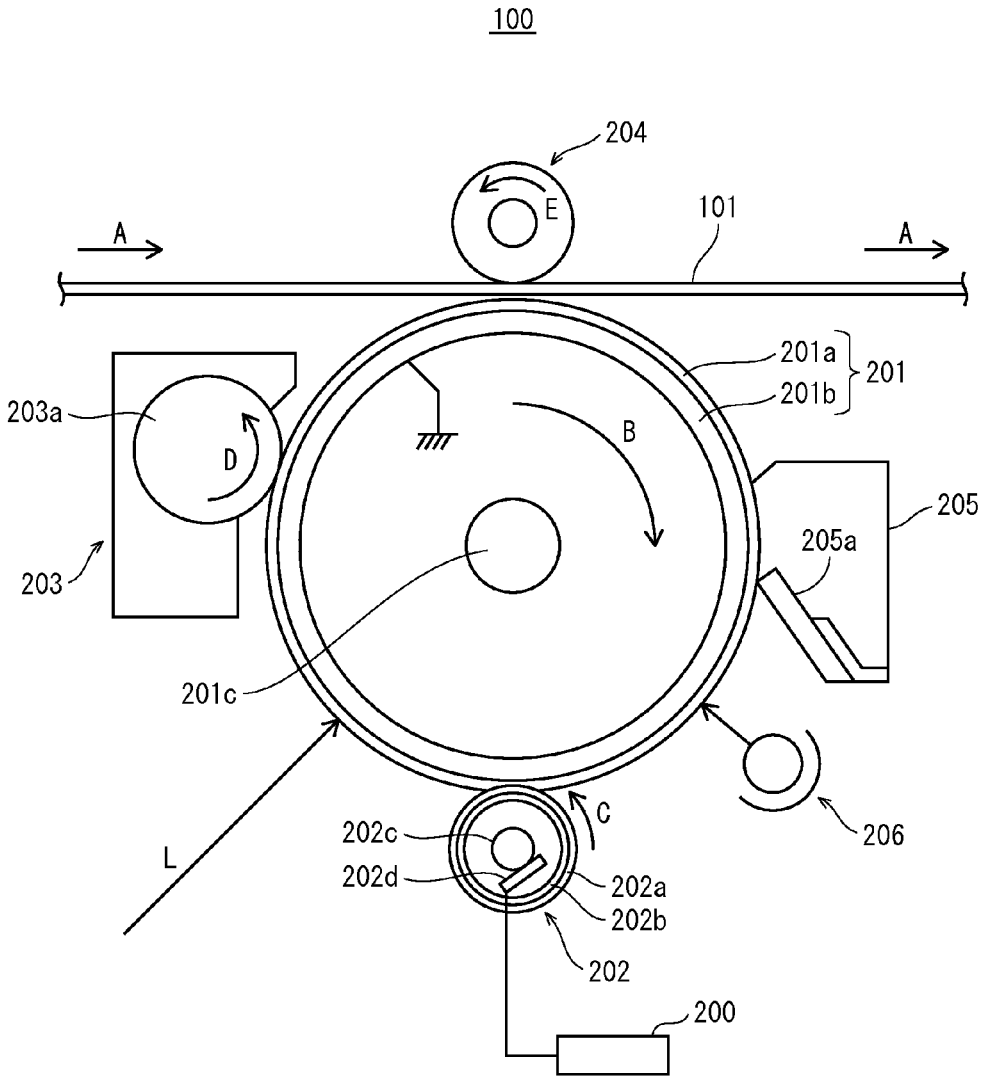
FIG. 2 shows primary components of an image creating unit 100.

As shown in FIG. 2, the image creating unit 100 includes: a photosensitive drum 201 having a columnar shape; and a charging roller 202, a developing device 203, a primary transfer roller 204, a cleaning device 205 and a neutralization lamp 206 which are arranged along the outer circumferential surface of the photosensitive drum 201 in this order.

The photosensitive drum 201 includes, for example, a drum body 201*b* made of aluminum and a photoreceptor layer (photoconductive layer) 201*a* made of negatively-charged organic photoreceptor formed on the outer circumferential surface of the drum body 201*b*. The photosensitive drum 201 is rotated about a shaft 201*c* in the direction indicated by the arrow B.

The charging roller 202 includes a cored bar 202*c*, a conductive layer 202*b* integrated with the cored bar 202*c* into one piece, and a high-conductivity layer 202*a* that is elastic and formed on the outer circumferential surface of the conductive layer 202*b*. The cored bar 202*c* is rotatably held by bearings, and is rotated in the direction indicated by the arrow C by the friction between the charging roller 202 and the photosensitive drum 201.

The charging roller 202 is pressed against the outer circumferential surface of the photosensitive drum 201 and thus a charting nip is formed. The charging roller 202 is supplied with power from a charging bias power supply device 200 via a slidable connector 202*d* sliding on the surface of the cored bar 202*c* and thus the outer circumferential surface of the photosensitive drum 201 is charged by contact with the slidable connector 202*d*.

The developing device 203 includes a developing roller 203*a* that rotates in the direction indicated by the arrow D with toner carried on the outer circumferential surface of the developing roller 203*a*. The developing roller 203*a* is located near the photosensitive drum 201 so as to face the photosensitive drum 201. Developing bias is applied to the developing roller 203*a*. Thus toner is supplied onto the outer circumferential surface of the photosensitive drum 201, and a toner image is formed on the outer circumferential surface by developing an electrostatic latent image.

The primary transfer roller 204 and the photosensitive drum 201 hold the intermediate transfer belt 101 between them. The primary transfer roller 204 rotates in the direction indicated by the arrow E in accordance with the rotation of the intermediate transfer belt 101 in the direction indicated by the arrow A. The primary transfer roller 204 is made by, for example, coating the surface of a cored bar of metal with elastic material. To the primary transfer roller 204, primary transfer bias having an opposite polarity as toner is applied from a power supply device which is omitted from the drawing. Consequently, the toner image carried on the outer circumferential surface of the photosensitive drum 201 undergoes the primary transfer to the intermediate transfer belt 101.

The cleaning device 205 collects a residue of toner remaining on the outer circumferential surface of the photosensitive drum 201 after the primary transfer by using a cleaning blade 205*a*. The neutralization lamp 206 removes the remaining charge on the outer circumferential surface of the photosensitive drum 201 by irradiating the outer circumferential surface of the photosensitive drum 201 with exposure light. Note that if the residual toner not removed by the cleaning device 205 and so on adheres to the charging roller 202, the charging properties of the charging roller 202 could be degraded. Therefore, a cleaning member for cleaning the charging roller 202 may be additionally provided.

[3] Waveform of Charging Bias Bc

The following explains the waveform of the charging bias Be output by the charging bias power supply device 200.

The charging bias Be pertaining to the present embodiment has a rectangular waveform when falling, until reaching the discharge start voltage Vth. After reaching the discharge start voltage Vth, the charging bias Be has a triangular waveform that falls at a slower rate than the rectangular waveform.

Figure 3A:
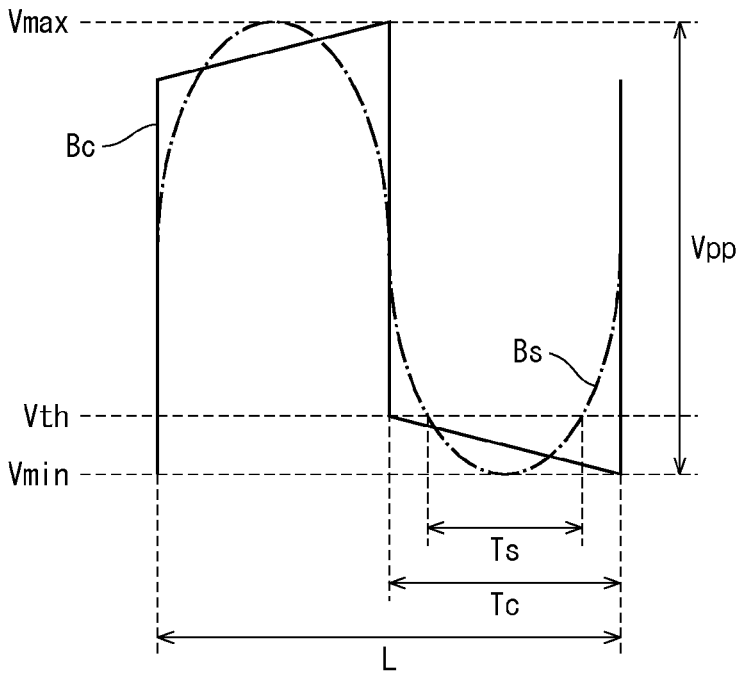
FIGS. 3A and 3B are graphs showing example waveforms of a charging bias Bc, a sinusoidal wave bias Bs and a rectangular wave bias Br for their respective wave periods L. Each of the waveforms has the same period L and the same peak-to-peak voltage Vpp. In particular, FIG. 3A compares the charging bias Bc with the sinusoidal wave bias Bs, and FIG. 3B compares the charging bias Bc with the rectangular wave bias Br.
Figure 3B:
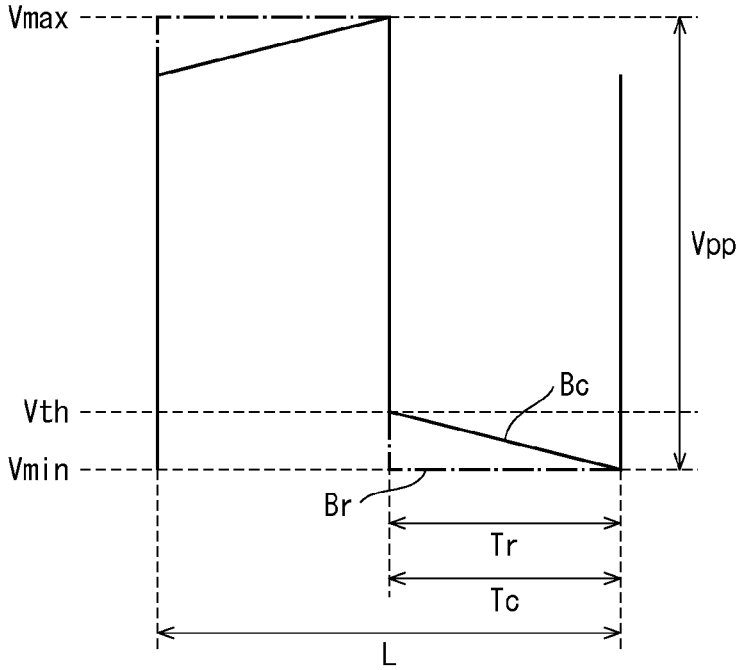

FIGS. 3A and 3B are graphs showing an example waveform of the charging bias Bc pertaining to the present embodiment, and in particular, FIG. 3A compares the charging bias Bc with a sinusoidal wave bias Bs, and FIG. 3B compares the charging bias Bc with a rectangular wave bias Br. Note that the charging bias Bc, the sinusoidal wave bias Bs and the rectangular wave bias Br have the same period L and the same peak-to-peak voltage Vpp, and they are all in phase with each other.

As shown in FIG. 3A, the charging bias Bc (depicted as a solid line), when falling, has a rectangular waveform until reaching the discharge start voltage Vth. Therefore, the charging bias Bc instantaneously falls to the discharge start voltage Vth. Due to this drop in electric potential, the difference in potential between the charging roller 202 and the surface of the photoreceptor layer 201*a* (caused by the charging bias Bc) is increased instantaneously. Discharge starts consequently.

After reaching the discharge start voltage Vth, the charging bias Bc has a triangular waveform, and falls moderately from the discharge start voltage Vth to the minimum voltage Vmin in a half wave period, and then rises instantaneously. That is, the potential difference between the charging roller and the surface of the photoreceptor layer 201*a* moderately increases during the half wave period, and then decreases instantaneously.

Therefore, within the period L, the discharge time Tc, during which the value of the charging bias Bc is no greater than the discharge start voltage Vth, is equal to the half period L/2, and is longer than the discharge time Ts, during which the value of the sinusoidal wave bias Bs (depicted as a dot-dash line) is no greater than the discharge start voltage Vth.

As shown in FIG. 3B, the rectangular wave bias Br (depicted as a dot-dash line), when falling, instantaneously reaches the minimum voltage Vmin that is lower than the discharge start voltage Vth. On the other hand, the value of the charging bias Bc falls at a slower rate than the rectangular wave bias Br (depicted as a dot-dash line) after reaching the discharge start voltage Vth.

Due to this waveform, the discharge time Tc, during which the value of the charging bias Bc is no greater than the discharge start voltage Vth, is kept equal to the discharge time Tr provided by the rectangular bias Br, but the risk of overshoot (within the range of approximately 50 V to approximately 300 V in absolute value), which the rectangular bias Br might cause, is avoided.

[4] Evaluation Experiments

The following describes evaluation experiments conducted to evaluate the performance in charging by using various sorts of charging bias Bc.

In the evaluation experiments, bizhub PRO C554, which is a product of Konica Minolta, inc., was used ("bizhub" is a registered trademark of the company). bizhub PRO C554 is a tandem color multi-function peripheral (MFP) that performs exposure with a laser having a wavelength of 780 nm, and performs intermediate transfer using reversal developing. According to the needs for the experiments, bizhub PRO C554 was modified so as to employ roller charging, and in the experiments, an image composed of YMCK colors each having a printing area ratio of 5% was printed on 25,000 sheets of A4 neutralized paper under an atmosphere with a temperature of 30° C. and a relative humidity of 85% RH, and the primary power source was turned off 60 seconds after the completion of the printing.

Then, the primary power source was turned on again twelve hours after being turned off. Upon the MFP became ready to print, a half-tone image having a relative reflection density of 0.4 measured with a Macbeth densitometer was printed on the entire area of a sheet of A3 neutralized paper. Subsequently, a 6-dot grid image was printed on the entire area of a sheet of A3 neutralized paper as well. Then, image deletion and non-uniform charging was evaluated by observation of the conditions of the printed images.

FIG. 4 is a table showing evaluation conditions for evaluating the performance in charging. Each graph shown in FIGS. 5 through 8 represents the charging bias Bc with which the performance in charging was evaluated. In each graph, the vertical axis represents the value of voltage (i.e. electric potential), and the horizontal axis represents the time. The period in which the value of voltage is no greater than the discharge start voltage Vth is the discharge time Tc.

Figure 5A:
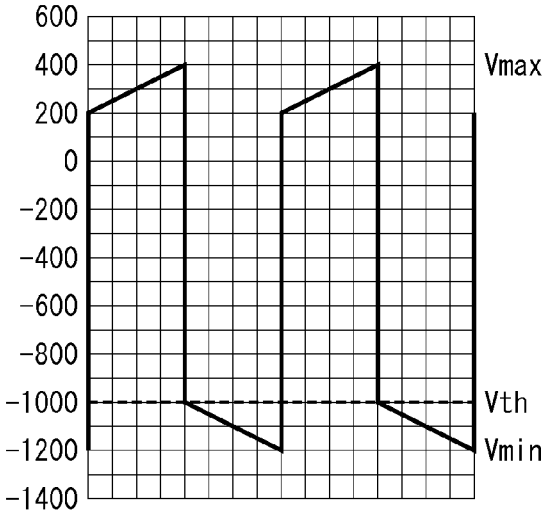
FIGS. 5A through 5C are graphs showing the waveforms of the charging bias Bc employed in Examples 1 through 3.
Figure 5B:
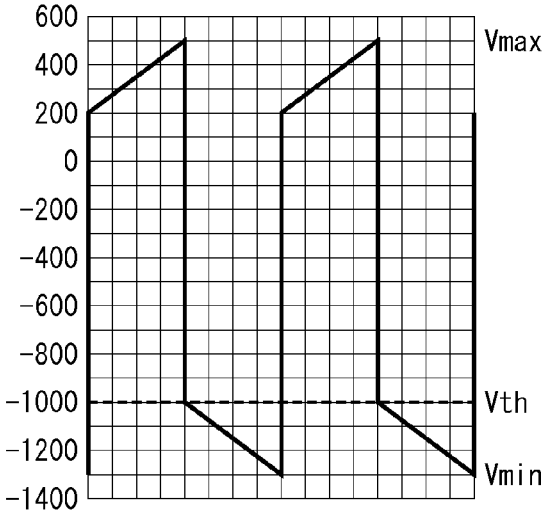
Figure 5C:
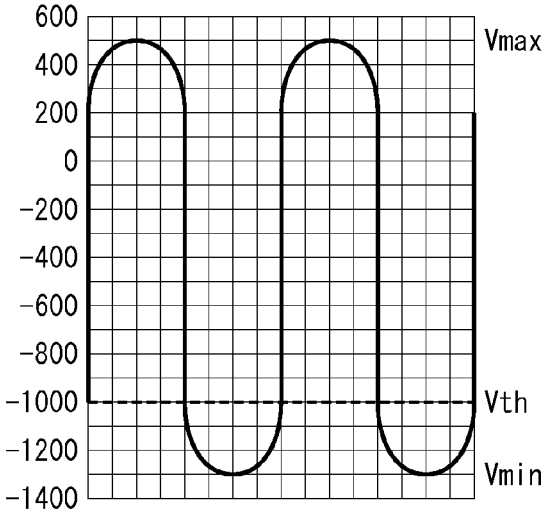
Figure 6A:
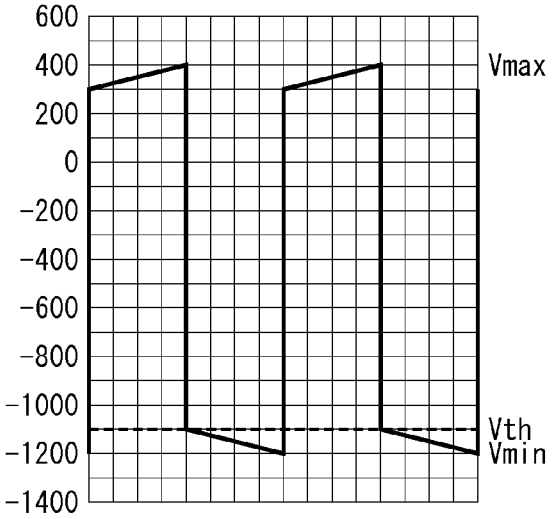
FIGS. 6A through 6C are graphs showing the waveforms of the charging bias Bc employed in Examples 4 through 6.
Figure 6B:
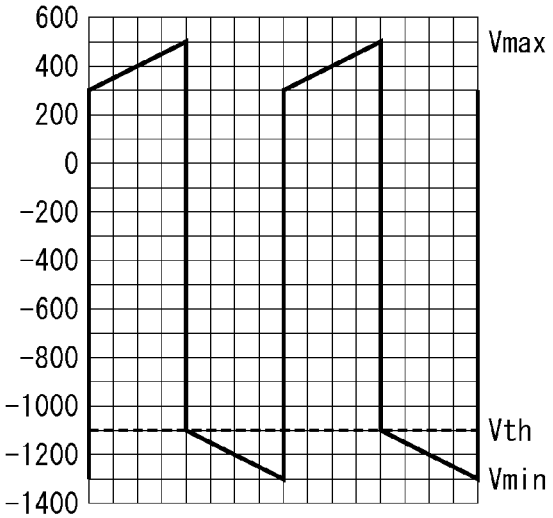
Figure 6C:
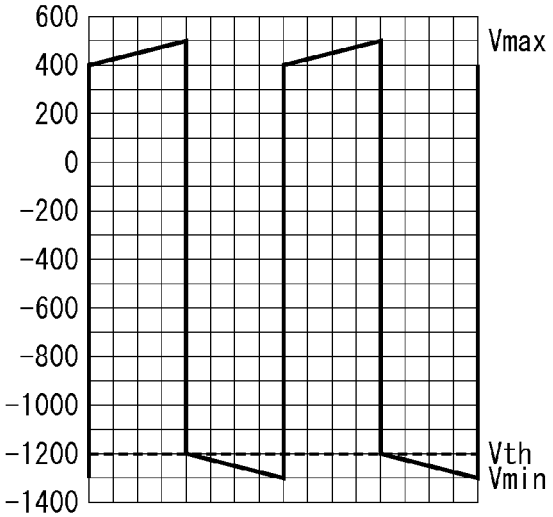
Figure 7A:
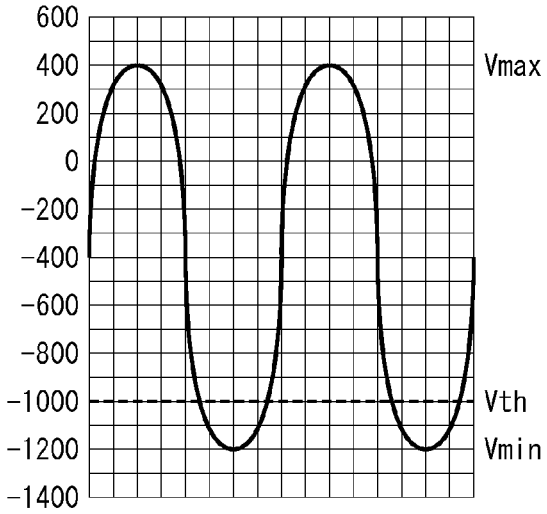
FIGS. 7A through 7C are graphs showing the waveforms of the charging bias Bc employed in Comparative Examples 1 through 3.
Figure 7B:
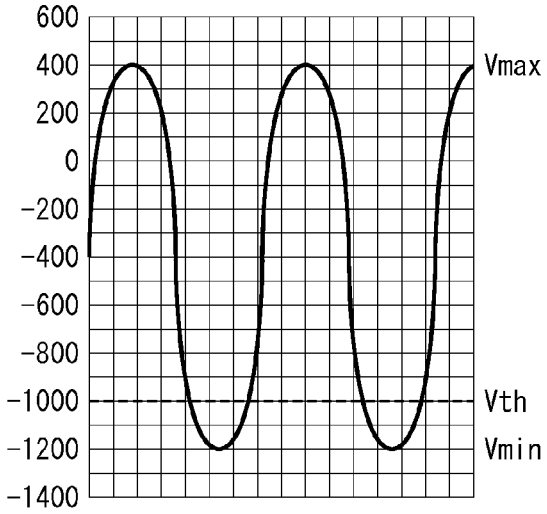
Figure 7C:
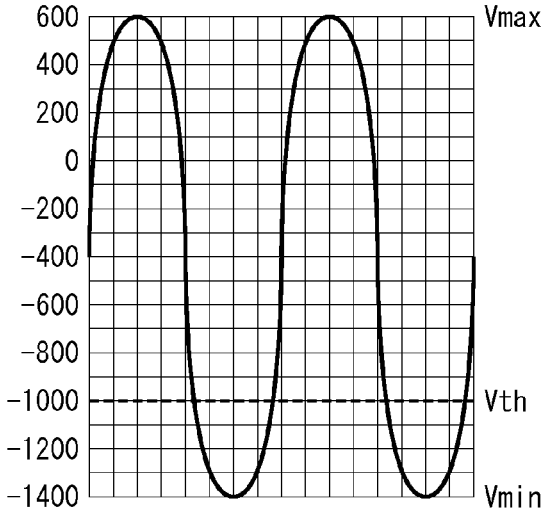
Figure 8A:
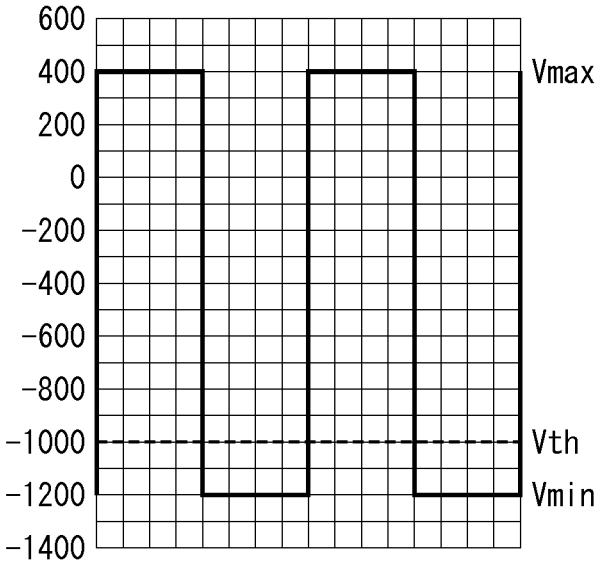
FIGS. 8A and 8B are graphs showing the waveforms of the charging bias Bc employed in Comparative Examples 4 and 5.
Figure 8B:
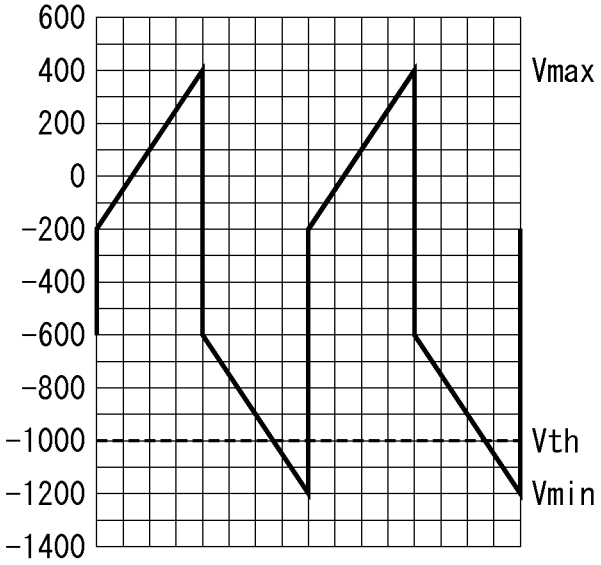

In FIG. 4, each of the charging bias Bc employed in Examples 1, 2 and 4 through 6 has a rectangular waveform until reaching the discharge start voltage Vth, and has a triangular waveform after reaching the discharge start voltage Vth. The charging bias Bc employed in Examples 1, 2 and 4 through 6 respectively correspond to the graphs shown in FIG. 5A, 5B and FIGS. 6A through 6C. The charging bias Be employed in Example 3 has a sinusoidal waveform after reaching the discharge start voltage Vth (FIG. 5C).

Each of the charging bias Bc employed in Comparative Examples 1 through 4 is, as shown in FIGS. 7A through 7C and FIG. 8, a sinusoidal wave or a rectangular wave. In Comparative Example 5, the charging bias Bc has a triangular waveform after reaching the minimum voltage of the rectangular wave that is greater than the discharge start voltage Vth (FIG. 8B). Note that the direct current bias of −400 V is applied in each of Examples 1 through 6 and Comparative Examples 1 through 5.

In the table, "Vth" denotes the discharge start voltage, "Vpp" denotes the peak-to-peak voltage of the charging bias Bc, and "Frequency" denotes the frequency F of the charging bias Bc. The waveform corresponding to the higher potential range (i.e. the waveform until the charging bias Bc reaches the discharge start voltage Vth) and the waveform corresponding to the lower potential range (i.e. the waveform after the charging bias Be reaches the discharge start voltage Vth) are regarded as waveforms of separate biases, and the peak-to-peak voltage Vpp and the waveform is specified for each bias. Needless to say, the peak-to-peak voltage Vpp of the charging bias Bc is equal to the sum of the respective peak-to-peak voltages Vpp of the waveform corresponding to the higher potential range and the waveform corresponding to the lower potential range.

"Photoreceptor film thickness" denotes the film thickness of the photoreceptor layer 201*a*, and "Normal" denotes 30 μm and "Thick" denotes 50 μm. "Environmental conditions" represents the environment for the experiments, and "Normal" denotes normal temperature and normal humidity, namely a temperature of approximately 20° C. and a relative humidity of 65% RH. "Low temperature, low humidity" denotes a temperature of 10° C. and a relative humidity of 15% RH.

"Discharge time ratio" represents the ratio, to the period L of the charging bias Bc, of the period in which the potential of the charging bias Bc is no greater than the discharge start voltage Vth. "Referential ratio" denotes the discharge time ratio of the sinusoidal wave bias Bs having the same discharge start voltage Vth and the peak-to-peak voltage Vpp as the charging bias Bc. The reference ratio is determined by the discharge start voltage Vth and the minimum voltage Vmin, independently from the frequency F of the charging bias Bc.

The image deletion is evaluated on a scale of four grades, namely excellent (◎), practically not problematic (○), feasible (Δ), and practically problematic (×). That is, when image deletion is not o bserved in either the half-tone image or the grid image, the performance in charging is evaluated as excellent (◎). When the image deletion is not observed in the grid image, but a strip of slightly lighter-colored low-density area, which extends in the direction along the rotational axis of the photosensitive drum 201, is observed only in the half-tone image, it cannot be said that the performance in charging is excellent. Instead, the performance is evaluated as practically not problematic (○).

When a strip of obviously lighter-colored low-density area, which extends in the direction along the rotational axis of the photosensitive drum 201, is observed only in the half-tone image, it cannot be said that the performance in charging is practically not problematic. Instead, the performance is evaluated as feasible (Δ). Furthermore, when any portion is missing from the grid image or a thin line is observed in the grid image, the performance in charging is evaluated as practically problematic (×).

The non-uniform charging was evaluated on a scale of two grades, namely excellent (○) and practically problematic (×). That is, the performance is evaluated as excellent (○) when there is no line-like noise in the half-tone image, and the performance is evaluated as practically problematic (×) when there is such a noise.

As shown in FIG. 4, regarding the evaluation results of the image deletion, Examples 1 through 6 and Comparative Examples 1, 2 and 5 are excellent (◎) or practically not problematic (○), and Comparative Example is feasible (Δ). On the other hand, Comparative Examples 2 and 3 are practically problematic (×). Regarding the evaluation results of the non-uniform charging, Examples 1 through 6 and Comparative Examples 2 and 3 are practically not problematic (○), whereas Comparative Examples 1, 4 and 5 are practically problematic (×).

Specifically, in Comparative Example 1, the non-uniform charging occurs because the applied bias is the sinusoidal wave bias Bs and there is not sufficient discharge time, which is indicated by the small discharge time ratio. In Comparative Example 2, the non-uniform charging is solved by increasing the frequency F of the sinusoidal wave bias Bs, but the image deletion still occurs because of the increase in the product of the discharge.

In Comparative Example 3, the discharge time is extended by increasing the peak-to-peak voltage Vpp, and the amount of discharge current is increased. However, prominent image deletion occurs because of the increase in the product of the discharge. In addition, in order to increase the peak-to-peak voltage Vpp, the increase in cost of the power supply device is inevitable.

When rectangular wave bias Br is used as in Comparative Example 4, overshoot is likely to occur at edges, which causes a great fluctuation in applied voltage. Accordingly, Comparative Example 4 readily causes non-uniform charging. In addition, due to a significant drop in potential caused by the overshoot, the product of the discharge is likely to increase. Also, there is a risk of accelerated degradation of the surface of the photoreceptor.

Furthermore, even when the rectangular wave bias Br and the triangular wave bias Bt are superposed, the discharge time becomes short when the absolute value of the minimum voltage Vmin of the rectangular wave bias Br is smaller than the absolute value of the discharge start voltage Vth as shown in Comparative Example 5. In such cases, it would be impossible to secure a sufficient amount of discharge current. Also, non-uniform charging would be prominent.

On the other hand, in Examples 1 through 6, the rectangular wave bias Br having the same minimum voltage Vmin as the discharge start voltage Vth is superposed. Therefore, the charging bias Bc instantaneously reaches the discharge start voltage Vth at the falling edges. Consequently, the discharge time ratio is increased, and sufficient discharge time can be secured. Therefore, it is possible to effectively prevent the non-uniform charging.

Also, since the discharge time is extended without increasing the peak-to-peak voltage Vpp, the increase of the product of the discharge, due to the rise in discharge voltage, is prevented. Furthermore, since the minimum voltage Vmin of the rectangular wave bias Br is kept high by superposing the triangular wave bias Bt or the sinusoidal wave bias Bs, the occurrence of non-uniform charging, caused by the overshoot of the rectangular wave bias Br, is prevented as well.

As described above, Examples 1 through 6 provide sufficient discharge time without increasing the peak-to-peak voltage Vpp, and accordingly prevent the image deletion and the non-uniform charging at the same time. This leads to excellent charging conditions, and realizes excellent image quality.

[5] Modifications

The present invention has been described above based on an embodiment. However, the present invention is not limited to the embodiment. The following modifications, are acceptable.

(1) According to Embodiment described above, the charging bias Bc has a rectangular waveform until reaching the discharge start voltage Vth, and has a triangular waveform or a sinusoidal waveform after reaching the discharge start voltage Vth. However, the present invention is not limited this. For example, the waveforms may switch at a boundary voltage Vb that has a smaller absolute value than the discharge start voltage Vth.

Figure 9A:
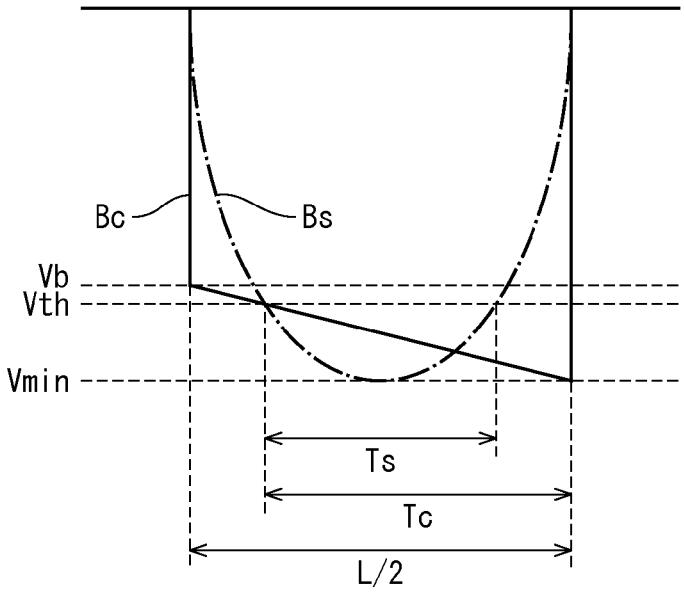
FIG. 9A is a graph showing discharge time Tc in the case where the charging bias Be is generated by superposing a triangular wave bias onto a rectangular wave bias having the minimum voltage Vmin whose absolute value is larger than the absolute value of discharge start voltage Vth.

As shown in FIG. 9A, even if the boundary voltage Vb is at a higher potential than the discharge start voltage Vth, the discharge time Tc of the charging bias Bc can be set longer than the discharge time Ts of the sinusoidal wave bias Bs having the same minimum voltage Vmin as the charging bias Bc by setting the boundary voltage Vb appropriately. Therefore, it is possible to extend the discharge time and improve the performance in charging without lowering the minimum voltage Vmin. Note that, as shown in Comparative Example 5, the discharge time Tc will be too short if the potential of the boundary voltage Vb is too high. Therefore, it is important not to set the potential of the boundary voltage Vb to be too high.

Figure 9B:
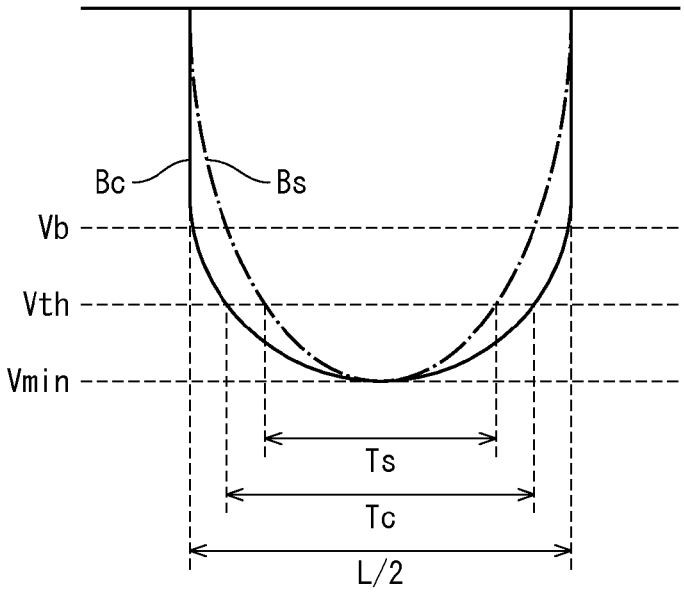
FIG. 9B is a graph showing the discharge time Tc in the case where the charging bias Bc is generated by superposing a sinusoidal wave bias onto the aforementioned rectangular wave bias.

In addition, in the case where the charging bias Bc has a sinusoidal waveform during the period in which the charging bias Bc has a potential lower than the boundary voltage Vb as shown in FIG. 9B, the discharge time Tc of the charging bias Bc can be set longer than the discharge time Ts of the sinusoidal wave bias Bs by setting the boundary voltage Vb to be lower than the direct current bias (−400 V in the embodiment above). Therefore, such a charging voltage can also improve the performance in charging without causing the increase in cost for increasing the voltage. Note that when the boundary voltage Vb is 0, the charging bias Bc has only the sinusoidal waveform, and such a waveform cannot extend the discharge time Tc.

Furthermore, since the boundary voltage Vb has a higher potential than the discharge start voltage Vth in any of the cases, the minimum voltage can be kept high even when the overshoot occurs at a falling edge of the charging bias Bc. Therefore, such a waveform can prevent the breakage, degradation and short life of the photoreceptor caused by the overshoot of the charging bias Bc.

(2) In the above-described embodiment, the charging bias Bc has a waveform that switches to a sinusoidal waveform or a triangular waveform when the charging bias BC reaches the discharge start voltage Vth. However, the present invention is not limited to this. The same advantageous effects can be achieved by using a charging bias that has a waveform switching to a waveform other than a sinusoidal waveform or a triangular waveform, unless the waveform does not rise or drop instantaneously like a rectangular waveform and does not have a risk of the occurrence of the overshoot. In other words, any waveform that drops and rises at a slower rate than the rectangular wave may be employed to achieve the same advantageous effects.

Figure 10:
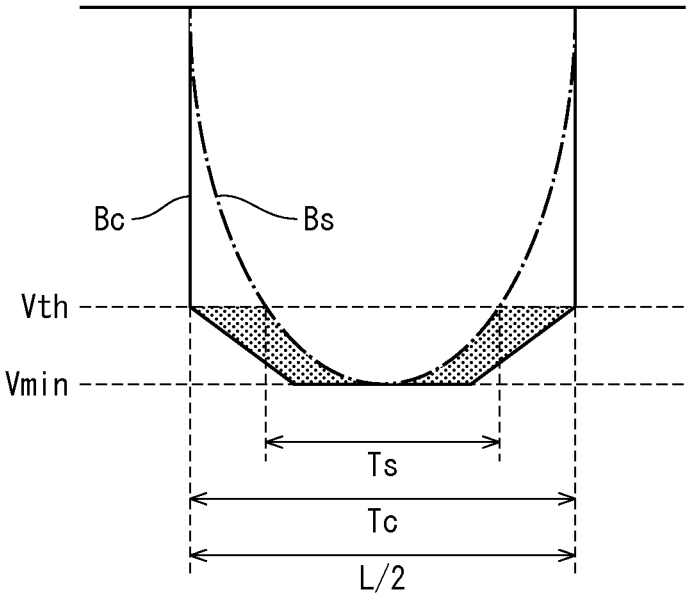
FIG. 10 is a graph showing the charging bias Bc generated by superposing trapezoidal wave bias onto rectangular wave bias having the minimum voltage Vmin that is equal to the discharge start voltage Vth.

FIG. 10 is a graph showing a charging bias Bc that has a trapezoidal waveform after reaching the discharge start voltage Vth. As shown in FIG. 10, compared to the sinusoidal wave bias Bs having the same minimum voltage Vmin, the charging bias Bc increases the amount of discharge current by an amount indicated by the shaded area in the graph. Such a waveform increases the amount of discharge current and improves the performance in charging without changing the minimum voltage Vmin.

(3) In the above-described embodiment, the method for obtaining the discharge start voltage Vth is not particularly specified. Since the discharge start voltage Vth might change according to various factors such as environmental conditions, the discharge start voltage Vth may be determined at a point when the image forming apparatus is powered on, at constant intervals (e.g. every 24 hours), a point when the image stabilization is performed, at a point immediately before execution of an image forming job, or the like, in the following manner.

Figure 11:
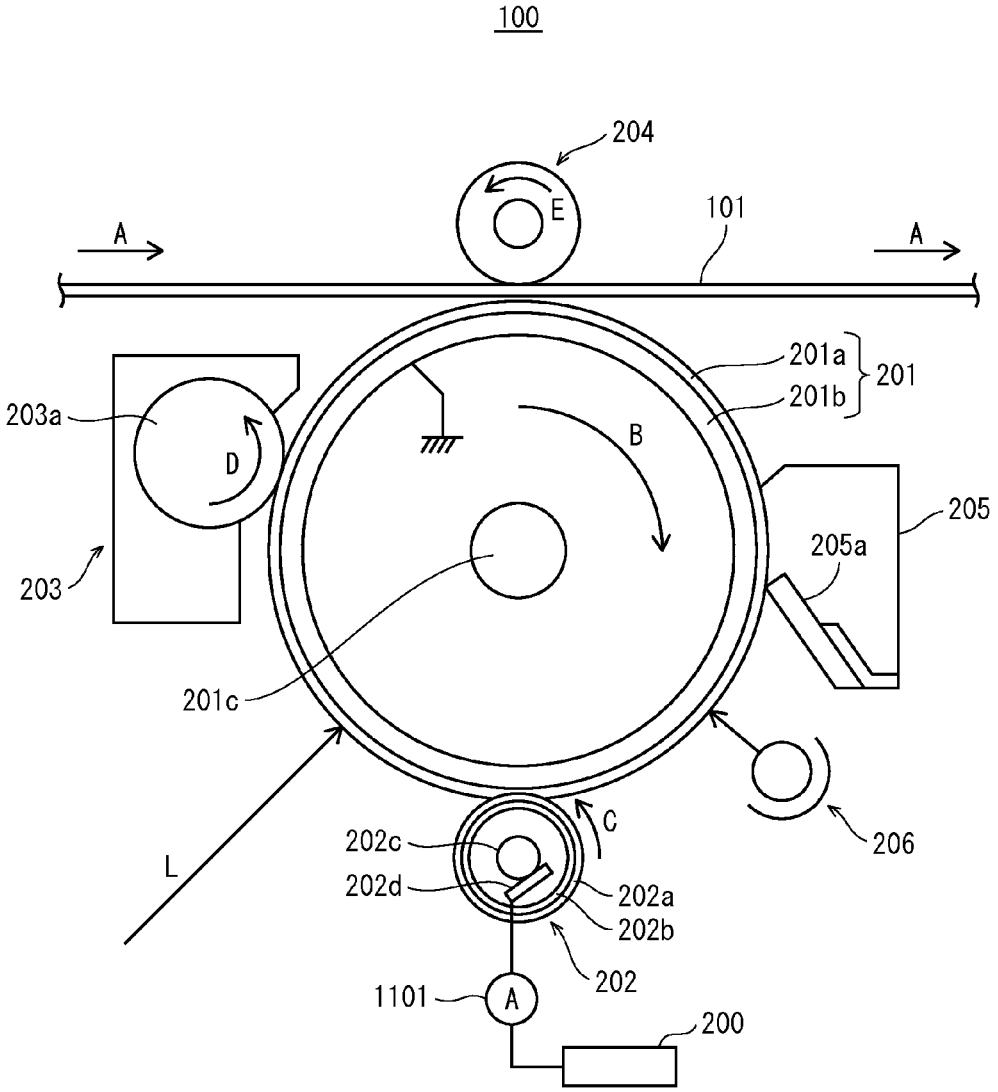
FIG. 11 shows primary components of an image creating unit 100 pertaining to Modification of the present invention.

FIG. 11 shows primary components of an image creating unit 100 pertaining to the present modification. As shown in FIG. 11, the image creating unit 100 pertaining to the present modification includes an ammeter 1101 for measuring the amount of current supplied from the charging bias power supply device 200. Using the ammeter 1101, the discharge start voltage Vth is detected in the following manner.

That is, the discharge start voltage Vth is a voltage at which the discharge to the photosensitive drum 201 starts when the electric potential applied to the charging roller 202 is gradually decreased. Upon the discharge starts, the amount of current flowing from the charging roller 202 to the photosensitive drum 201 sharply increases. Focusing on this fact, the charging bias power supply device 200 pertaining to the present modification monitors the amount of current detected by the ammeter 1101 while moderately lowering the minimum voltage Vmin of the rectangular wave bias applied to the charging roller 202. The minimum voltage Vmin of the rectangular bias, at which the amount of current has sharply increased, is determined as the discharge start voltage Vth.

Figure 12:
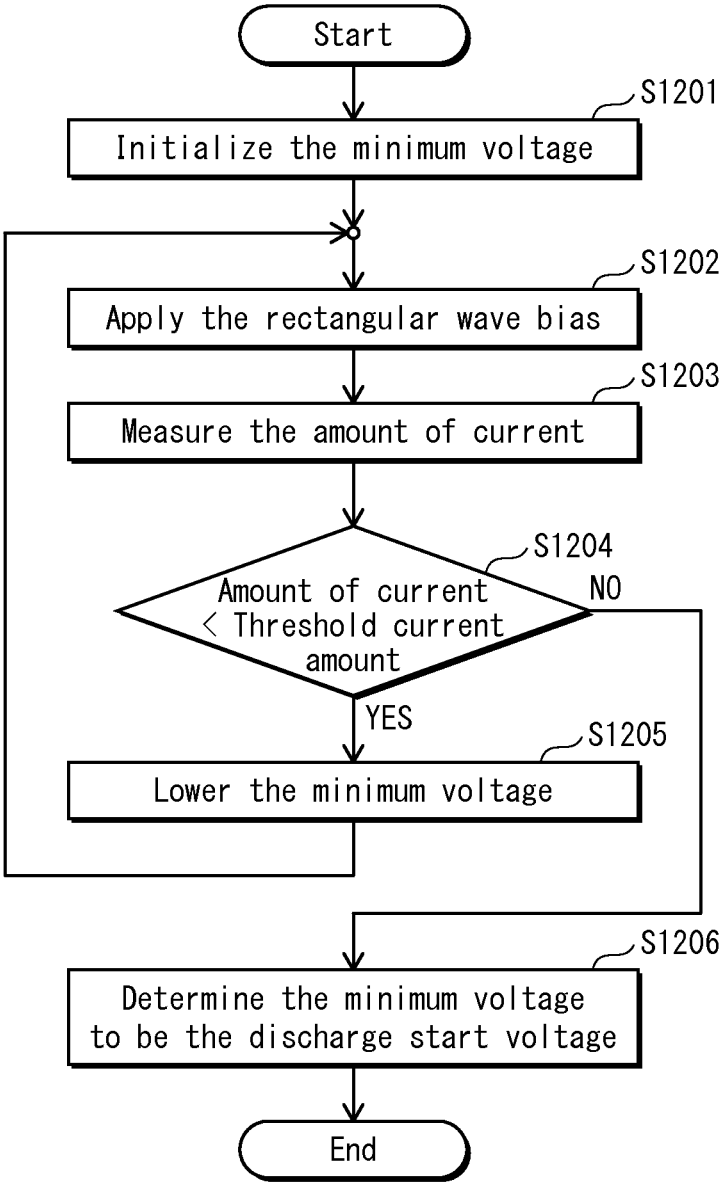
FIG. 12 is a flowchart of operations for detecting the discharge start voltage Vth.

FIG. 12 is a flowchart of operations for detecting the discharge start voltage Vth. As shown in FIG. 12, the charging bias power supply device 200 first initializes the minimum voltage Vmin of the rectangular bias to be at a sufficiently high potential (S1201), next applies the rectangular bias to the charging roller 202 (S1202), and then measures the amount of current by using the ammeter 1101 (S1203).

When the amount of current thus measured is less than the threshold current amount (S1204: YES), the charging bias power supply device 200 lowers the potential of the minimum voltage Vmin (S1205), and then applies the rectangular bias at a different potential to the charging roller 202 (S1202). The charging bias power supply device 200 repeats these operations, and when the amount of current measured by the ammeter 1101 becomes equal to or greater than the threshold current amount (S1204: NO), the minimum voltage Vmin at this time point is determined as the discharge start voltage Vth.

Note that the threshold current amount is larger than the amount of current that flows before the discharge starts (i.e. 0A) and is smaller than the amount of current that flows after the discharge starts. Note that the amount of the potential drop of the minimum voltage Vmin caused in Step S1205 is preferably as small as possible in order to determine the discharge start voltage Vth with high accuracy.

Alternatively, it is possible to estimate the discharge start voltage Vth by sequentially changing the minimum voltage Vmin to various values, comparing the amounts of current measured by the ammeter 1101 corresponding to the values of the minimum voltage Vmin, and finding the value of the minimum voltage Vmin at which the amount of current shows a significant change from the previous or subsequent amount. Furthermore, the minimum voltage Vmin may be changed by changing the peak-to-peak voltage Vpp, or by changing the direct current bias.

The above-described procedure is for the case where the photoreceptor layer 201*a* is negatively charged. When the photoreceptor layer 201*a* is positively charged, the discharge start voltage Vth can be obtained based on the minimum voltage Vmin. In other words, the discharge start voltage Vth can be obtained from the peak voltage Vp regardless of whether the photoreceptor layer 201*a* is negatively charged or positively charged.

(4) In the above-described modification, the discharge start voltage Vth is obtained based on the changes in the amount of current. However, the present invention is not limited to this. For example, the following method may be used.

The discharge start voltage Vth increases as the temperature within the image forming apparatus 1 decreases, and increases as the thickness of the photoreceptor layer 201*a* increases. The thickness of the photoreceptor layer 201*a* is correlative to the number of photoreceptor sheets used in the photoreceptor layer 201*a*. For this reason, the discharge start voltage Vth may be estimated with reference to a table that shows the relationship between the discharge start voltage Vth, the temperature within the apparatus, and the number of the photoreceptor sheets.

(5) In the above-described embodiment, how to determine the minimum voltage Vmin of the charging bias Bc is not specified. However, it can be said that the minimum voltage Vmin is preferably set within the range from the potential 300 V lower than the discharge start voltage Vth to the potential 100 V higher than the discharge start voltage Vth. The discharge start voltage Vth may be determined according to the above-described modification, for example.

In addition, it is preferable that the peak voltage Vp of the portion of the charging bias Bc having the rectangular waveform is determined based on the discharge start voltage Vth estimated by the measurement or by referring to the table, and it is more effective to determine the waveform of the charging bias Bc so that the peak voltage Vp of the portion having the rectangular waveform coincides with the discharge start voltage Vth thus estimated.

Alternatively, the advantageous effects of the present invention can also be obtained when the peak voltage of the portion having the rectangular waveform is increased or decreased from the discharge start voltage by from several tens of volts to a hundred and several tens of volts.

(6) According to the above-described embodiment, the image forming apparatus is a tandem color printer. However, this is not essential for the present invention. The present invention may be applied to non-tandem color printers. Furthermore, it is possible to achieve the same advantageous effects by applying the present invention to copy machines having a document scanner, facsimile machines having a communication function, or multi-function peripherals (MFPs) having the functions of both copy machines and facsimile machines.

[6] Summary

Finally, the following summarizes the advantageous effects.

One aspect of the present invention provides an image forming apparatus for forming an image from an electrostatic latent image generated by exposing an electrically charged photoreceptor to light, comprising: a contact charging unit that is in contact with a photoreceptor and electrically charges the photoreceptor by causing electric discharge; a bias applying unit that applies an alternating current bias to the contact charging unit; and a superposing unit that superposes a direct current bias onto the alternating current bias, the direct current bias having a same polarity as a charge polarity of the photoreceptor, wherein the alternating current bias has a same waveform as a rectangular wave bias during a period in which an absolute value of the alternating current bias is smaller than an absolute value of a predetermined boundary voltage, and the absolute value of the alternating current bias increases at a slower rate than an absolute value of the rectangular wave bias during a period in which the absolute value of the alternating current bias is equal to or greater than an absolute value of a discharge start voltage, the discharge start voltage being a voltage at which the electric discharge occurs between the contact charging unit and the photoreceptor and having a same polarity as the charge polarity of the photoreceptor, and the absolute value of the predetermined boundary voltage being no greater than the absolute value of the discharge start voltage, and a discharge time provided by the alternating current bias, for which the absolute value of the alternating current bias is equal to or greater than the absolute value of the discharge start voltage, is longer than the discharge time provided by a sinusoidal wave bias having a same frequency and a same amplitude as the alternating current bias, and is no longer than the discharge time provided by a rectangular wave bias having the same frequency and the same amplitude as the alternating current bias. This structure allows for preferable charging with an increased amount of discharge current compared to a sinusoidal wave bias, without increasing the peak-to-peak voltage Vpp. In addition, the stated structure extends the discharge time as much as possible, and prevents a charging failure and degradation of the photoreceptor which could be caused by overshoot of the rectangular wave bias.

In the stated structure, it is preferable that the predetermined boundary voltage is equal to the discharge start voltage, and is furthermore preferable that the alternating current bias has either a sinusoidal waveform or a triangular waveform during the period in which the absolute value of the alternating current bias is equal to or greater than the absolute value of the discharge start voltage. By superimposing the rectangular wave bias, it is possible to instantaneously increase the absolute value of the alternating current bias, thereby extending the discharge time.

Alternatively, the image forming apparatus may further comprise: a current detection unit that measures the amount of current flowing from the contact charging unit to the photoreceptor; and a discharge start voltage detecting unit that measures the amount of the discharge start voltage by causing the current detection unit to measure the amount of the current while sequentially applying rectangular wave biases respectively having different peaks to the contact charging unit, the peaks having a same polarity as the charge polarity of the photoreceptor, wherein the bias applying unit may determine a waveform of the alternating current bias according to the amount of the discharge start voltage measured by the discharge start voltage detecting unit.

The discharge start voltage Vth might change according to the environmental conditions or damages over time to the image forming apparatus. The stated structure allows for determination of the waveform of the alternating current bias with high accuracy according to the discharge start voltage Vth that changes. Needless to say, the discharge start voltage detecting unit may repeatedly measure the amount of the discharge start voltage at predetermined intervals.

In addition, it is preferable that the alternating current bias is generated by superposing a second bias onto a first bias, the first bias having a rectangular waveform, and a waveform of the second bias having edges that change at a slower rate than edges of the rectangular waveform, and that the bias applying unit determines the waveform of the alternating current bias by controlling a peak of the first bias.

In particular, it is preferable that the bias applying unit determines the waveform of the alternating current bias such that the peak of the first bias coincides with the discharge start voltage measured by the discharge start voltage detecting unit.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image forming apparatus for forming an image from an electrostatic latent image generated by exposing an electrically charged photoreceptor to light, comprising:

a contact charging unit that is in contact with a photoreceptor and electrically charges the photoreceptor by causing electric discharge;

a bias applying unit that applies an alternating current bias to the contact charging unit; and a superposing unit that superposes a direct current bias onto the alternating current bias, the direct current bias having a same polarity as a charge polarity of the photoreceptor, wherein the alternating current bias has a same waveform as a rectangular wave bias during a period in which an absolute value of the alternating current bias is smaller than an absolute value of a predetermined boundary voltage, and the absolute value of the alternating current bias increases at a slower rate than an absolute value of the rectangular wave bias during a period in which the absolute value of the alternating current bias is equal to or greater than an absolute value of a discharge start voltage, the discharge start voltage being a voltage at which the electric discharge occurs between the contact charging unit and the photoreceptor and having a same polarity as the charge polarity of the photoreceptor, and the absolute value of the predetermined boundary voltage being no greater than the absolute value of the discharge start voltage, and a discharge time provided by the alternating current bias, for which the absolute value of the alternating current bias is equal to or greater than the absolute value of the discharge start voltage, is longer than the discharge time provided by a sinusoidal wave bias having a same frequency and a same amplitude as the alternating current bias, and is no longer than the discharge time provided by a rectangular wave bias having the same frequency and the same amplitude as the alternating current bias.

2. The image forming apparatus of claim 1, wherein the predetermined boundary voltage is equal to the discharge start voltage.

3. The image forming apparatus of claim 2, wherein the alternating current bias has either a sinusoidal waveform or a triangular waveform during the period in which the absolute value of the alternating current bias is equal to or greater than the absolute value of the discharge start voltage.

4. The image forming apparatus of claim 1 further comprising:

a current detection unit that measures the amount of current flowing from the contact charging unit to the photoreceptor; and a discharge start voltage detecting unit that measures the amount of the discharge start voltage by causing the current detection unit to measure the amount of the current while sequentially applying rectangular wave biases respectively having different peaks to the contact charging unit, the peaks having a same polarity as the charge polarity of the photoreceptor, wherein the bias applying unit determines a waveform of the alternating current bias according to the amount of the discharge start voltage measured by the discharge start voltage detecting unit.

5. The image forming apparatus of claim 4, wherein the discharge start voltage detecting unit repeatedly measures the amount of the discharge start voltage at predetermined intervals.

6. The image forming apparatus of claim 4, wherein the alternating current bias is generated by superposing a second bias onto a first bias, the first bias having a rectangular waveform, and a waveform of the second bias having edges that change at a slower rate than edges of the rectangular waveform, and the bias applying unit determines the waveform of the alternating current bias by controlling a peak of the first bias.

7. The image forming apparatus of claim 6, wherein the bias applying unit determines the waveform of the alternating current bias such that the peak of the first bias coincides with the discharge start voltage measured by the discharge start voltage detecting unit.

* * * * *